US006651269B1

(12) United States Patent
Najar

(10) Patent No.: US 6,651,269 B1
(45) **Date of Patent: *Nov. 25, 2003**

(54) NECK SUPPORT CUSHION FOR UTILIZATION IN CONJUNCTION WITH HAIR TREATMENT

(76) Inventor: Michael Najar, 2407 Old Mill Rd., Spring Lake, NJ (US) 07762

( * ) Notice: Subject to any disclaimer, the term of this patent is extended or adjusted under 35 U.S.C. 154(b) by 0 days.

This patent is subject to a terminal disclaimer.

(21) Appl. No.: 10/412,036

(22) Filed: Apr. 14, 2003

(51) Int. Cl.[7] ..... A45D 44/10
(52) U.S. Cl. ..... 4/523
(58) Field of Search ..... 4/515–523, 575.1; 5/636

(56) References Cited

U.S. PATENT DOCUMENTS 1,721,571 A * 7/1929 Miller ..... 4/575.1
5,978,980 A * 11/1999 Flora ..... 4/523
6,513,176 B1 * 2/2003 Najar ..... 4/523

* cited by examiner

*Primary Examiner*—Charles E. Phillips
(74) *Attorney, Agent, or Firm*—Clifford G. Frayne

(57) ABSTRACT

An anatomically-correct neck and head support removably securable to a standard configuration salon or barbar's sink for use when the individual is placed in a reclined position, the support being a light weight foam or resilient material being water resistant, chemical resistant and washable and sanitizable, the upper surface of the neck support having a double arcuate surface complimentary with the normal cervical lordotic curve of the individual's spine and neck, the support also providing planar and lateral support to the neck area of the individual, the neck and head support having suction means secured thereto for secure engagement with the inner and outer surfaces of the front wall of a salon sink.

5 Claims, 3 Drawing Sheets

NECK SUPPORT CUSHION FOR UTILIZATION IN CONJUNCTION WITH HAIR TREATMENT

BACKGROUND OF THE INVENTION

1. Field of the Invention

The present invention relates to the field of neck and head supports and, in particular, a neck support cushion cooperable with a sink for hair shampooing, rinsing, permanents, dying and the like in a reclining position.

2. Description of the Prior Art

Both men and women utilize the services of barbers and beauticians in order to have their hair styled, shampooed and rinsed, dyed, or to have a permanent performed. A procedural element of all the aforementioned is the reclining of the individual, rearwardly, so that the hair can be positioned over an adjacent sink for rinsing with water.

This positioning of the individual is often awkward and uncomfortable in that the person's head is oftentimes positioned lower than the chest cavity, and that portion of the person's head having active hair follicles, must extend over the sink. Support therefore must be placed in the non-hair growing region of the neck.

Various attempts have been made to mollify the awkwardness and uncomfortableness of this positioning. These attempts include U.S. Pat. No. 1,244,715 to Dozier et al. which attempts to move the support upwardly from the sink; U.S. Pat. No. 727,452 to Romans, which suggests an alternative form of headrest; U.S. Pat. No. 2,803,834 to McClung for another form of extension apparatus; U.S. Pat. No. 4,167,048 to Williams for a support and runoff collection apparatus; U.S. Pat. No. 4,327,452 to Swatzell which illustrates a neck support pad which secures directly to the lip of the sink; U.S. Pat. No. 4,385,408 to Rhodes which again discloses another cushioning pad which is secured to the sink.

Applicant is the holder of U.S. Pat. No. 5,924,145 and U.S. Pat. No. 6,513,176 that provides for an anatomically correct support designed to conform to the normal cervical lordotic curve which provides for support to the upper mid back region extending upwardly to support the base of the head and neck. These patents are incorporated herein. This contour allows the back, shoulder and neck muscles to relax and maintain the neutral position of the neck curve preventing extension which is a common cause of neck, should and head pain. This reference is hereby incorporated herein.

Applicant has improved upon the subject matter of U.S. Pat. No. 6,513,176 so as to provide additional securing aids and further improvements from the standpoint of the hair salonist and the client to prevent fluid from draining down the client's neck and maintain the support in its correct position.

SUMMARY OF THE INVENTION

An anatomically correct neck and head support removably securable to a barber or salon sink for use when the individual is placed in a reclined position, the apparatus being comprised of a lightweight foam or resilient material being water-resistant, chemical-resistant, washable and sanitizable, the upper surface having an arcuate surface complimentary with the normal cervical lordotic curve of an individual's spine, the apparatus providing planar and lateral support for the neck area of the individual and capable of being fit over the lip of the sink, the neck support having transverse walls between depending legs to provide additional cushioning and a lordotic curve dam to prevent fluid from migrating to the user's back, the inner surface of the inner sink leg having a plurality of suction means for engaging the inner surface of the sink, the outer sink leg having attached thereon a plurality of suction means for engaging the outer surface of the sink.

OBJECTS OF THE INVENTION

An object of the present invention is to provide for a novel neck and head support removably securable to a barber or salon sink, the support having an upper surface conforming to the normal cervical lordotic curve allowing support of the mid back region extending upwardly to support the base of the head and neck.

A further object of the present invention is to provide for a novel support which will support the neck and head in a relaxed, comfortable position when reclined in a barber or beautician's chair thereby reducing the risk of cervical strain, sprain, neck injuries and pinched nerves, headaches and muscle spasms.

A still further object of the present invention is to provide for a novel support which reduces the risk of diminished vertebral or carotid blood flow to the brain.

A still further object of the present invention is to provide for a novel support which is both water resistant and chemical resistant and capable of being sanitized.

A still further object of the present invention is to provide for a novel support which limits the ability of a barber or beautician to hyper-extend or rotate the individual's head and neck.

A still further object of the present invention is to provide for a novel support which hinders or prevents fluid from migrating down the user's neck and back.

A still further object of the present invention is to provide for a novel support which incorporates a plurality of suction securing means to aid in maintaining it in its correct position.

BRIEF DESCRIPTION OF THE DRAWINGS

These and other objects of the present invention will be more apparent particularly when taken in view of the accompanying illustrations wherein.

DETAILED DESCRIPTION OF THE DRAWINGS

Figure 1:
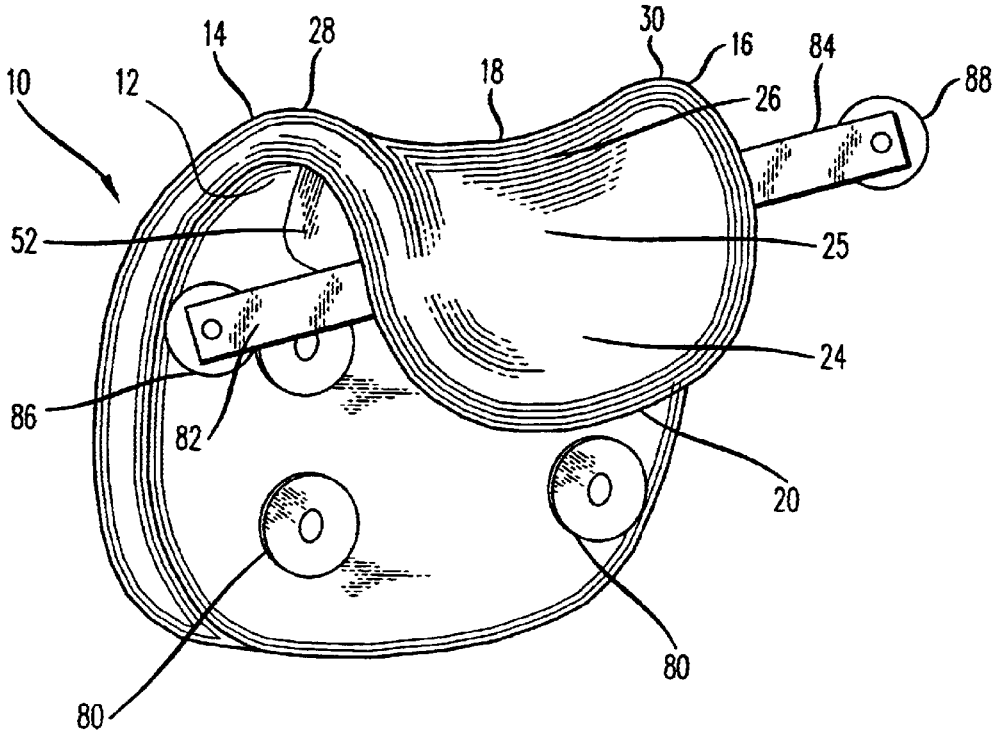
FIG. 1 is a perspective view of an embodiment of the present invention.

FIG. 1 is a perspective view of neck support 10. Neck support 10 is essentially a molded cushion of a flexible resilient material which is preshaped and which is water resistant and chemical resistant. The preformed neck support cushion 10 has a base 12, side panels 14 and 16 and an upper surface 18. Side panel 14 and 16 and upper surface 18 cooperate to form an arcuate surface having separately-defined sectors.

From the front 20 of neck support 10 to the rear 22 of neck support 10, upper surface 18 commences with a gentle upward slope in sector 24, the slope increasing in sector 25 and reaching an apex in sector 26 at which point the arcuate slope descends severely, thereby defining the rear portion 22 of neck support 10.

The arcuate surface of upper surface 18 through sectors 24, 25 and 26 correspond to the normal cervical lordotic curve of an individual's spine, which commences in the upper back region of an individual medial the shoulder blades, and extends through the neck region to the base of the skull.

In addition to upper surface 18 having this gradually upwardly sloping arcuate surface to sector 26 followed by a rapidly descending arcuate surface, upper surface 18 also has an arcuate shape extending from side panel 14 to side panel 16, neck support 10, thus exhibiting a double curved upper surface 18.

This second curvature of upper surface 18 is bilateral with respect to the longitudinal axis of neck support 10 running from front end 20 to rear end 22. This second curvature is designed to support the neck and cervical area so as to prevent any radical rotation of the neck and the head. This second curvature which runs transverse on neck cushion 10 has its respective apexes 28 and 30 proximate to side panels 14 and 16 respectively. The curvature or slope descends from these apexes downwardly and medially until it melds into sectors 24, 25 and 26 of the longitudinal curvature of neck support 10. The transverse curvature depends medially towards the longitudinal axis, the greatest distance proximate to the apex 28 and 30 and decreases its downward medial slope towards the longitudinal axis as it approaches front end 20 and rear end 22. The transverse curvature therefore defines a valley or depression which commences with a low elevation in sector 24 having increasing elevation through sector 25 to sector 26, thereafter, the arcuate elevation decreasing rapidly to end 22. The transverse curvature defines two (2) mounds on opposing sides of the valley or depression defined by apexes 28 and 30 which provide side to side resistance and thus prevent any radical or sudden rotation of the neck or head, since the depression or valley defines the location wherein there would be positioned the nape of the individual's neck.

Figure 2:
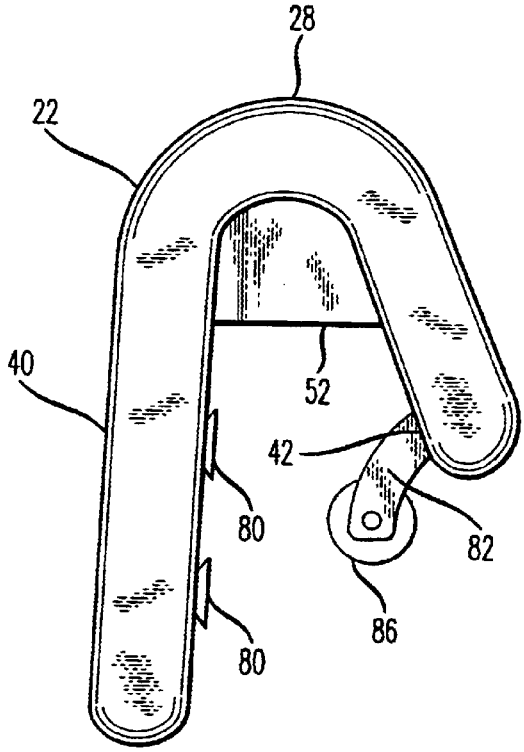
FIG. 2 is a side view of an embodiment of the present invention.
Figure 5:
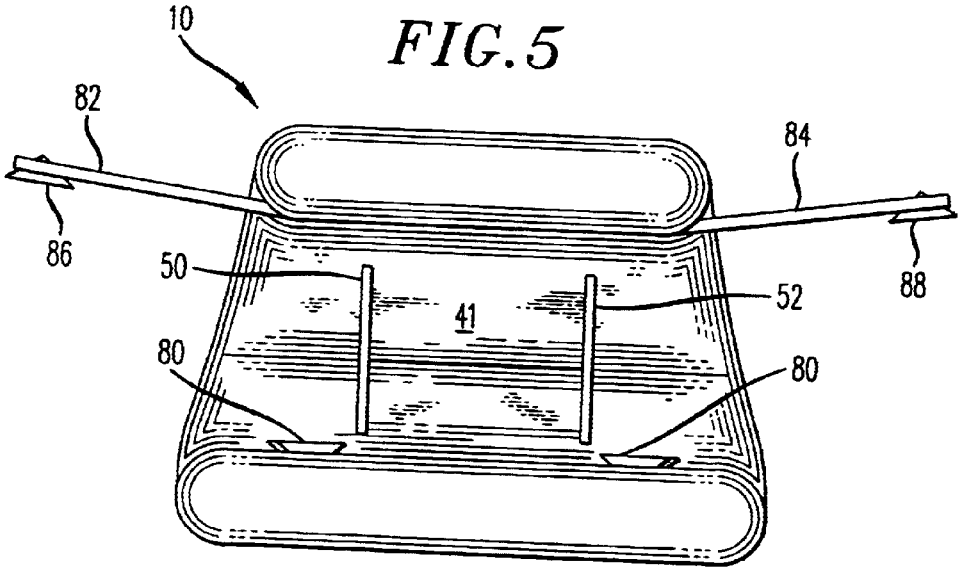
FIG. 5 is a bottom view illustrating the ribs between the legs.

The neck support 10 has two depending legs 40 and 42 depending from the base 12 which are integral with the neck supporting portion. FIG. 2. Depending leg 40 depends downwardly from base 16 proximate to rear 22 of neck support 10. Depending leg 42 is spaced apart from depending leg 40. The spaced apart distance 41 between leg 40 and 42 is designed to be cooperative with the thickness of the edge of the salon sink. FIGS. 1, 2 and 5 also illustrate transverse ribs 50 and 52 which are resiliently deformable such that they provide additional cushion support when neck support 10 is positioned on a sink edge. Depending legs 40 and 42 have a slight degree of lateral curvature as they extend between side panels 14 an 16.

Figure 3:
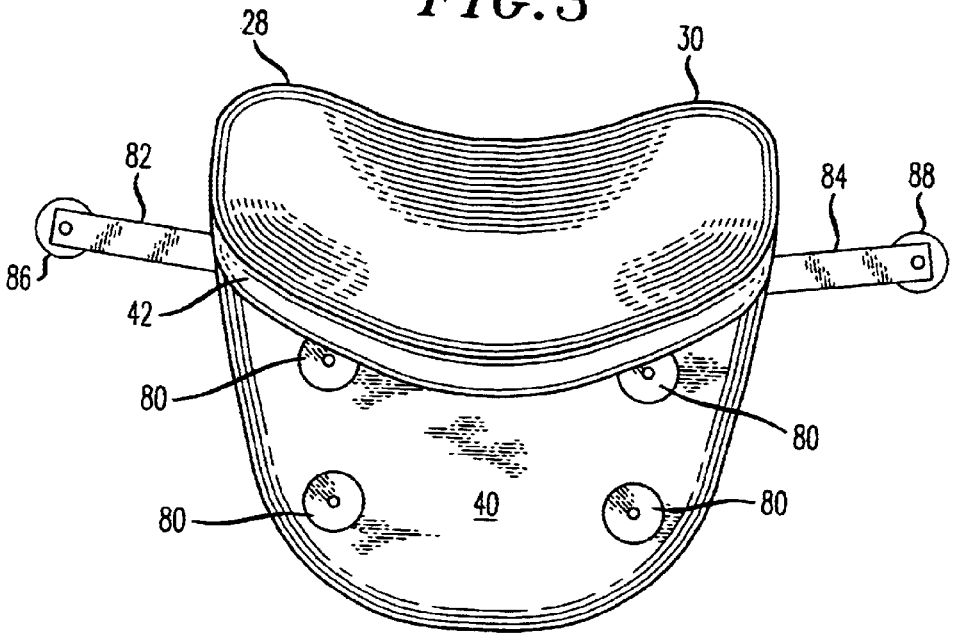
FIG. 3 is a front view of an embodiment of the present invention.

FIG. 3 is a front view of the neck support 10 which further discloses that depending leg 40, which is rearwardly placed on base 12 is slightly longer in dimension than depending leg 42 which is positioned forward of depending leg 40. This length differential provides additional support when cooperative with the edge of the sink and prevents movement of the neck support 10 when in use.

FIGS. 1 and 3 also illustrate a plurality of securing means which assist in maintaining the neck support 10 in its proper position on the sink 60. There is positioned on the inner surface of depending leg 40, a plurality of suction means 80 in the form of suction cups which are designed to engage the interior surface of front wall 72 of sink 60. The number of suction means can vary, but in the preferred embodiment developed by Applicant, four such suction means 80 secured to the interior surface of depending leg 40 achieve the desired results with respect to depending leg 40.

Depending leg 42 which extends downwardly over the outer surface of front wall 72 of sink 60 has attached to the undersurface thereof, a pair of flexible straps 82 and 84 having attached to the ends thereof, a suction means 86 and 88 for engagement with the outer surface of front wall 72 of sink 60. Straps 82 and 84 are secured at an oblique angle such that when the suction cups 86 and 88 are engaged with the outer surface of front wall 72, they exert the proper tension and securing means onto depending leg 42. The suction means serves several purposes. The suction cups 86 and 88 secured to depending leg 42 maintain the neck support 10 in position and prevent it from being dislodged if the end of the salon chair should catch depending leg 42 when it is being returned to a vertical position. Still further, the suction means prevents any forward or backward translation of the neck support 10 and minimizes any lateral motion.

The suction means serve to more accurately position the neck support 10 and to permit the neck support 10 to be utilized on a variety of different sink configurations without having to increase or decrease the size of the neck support 10 since salon sinks typically have different heights and angles of positioning with respect to their front walls.

Figure 4:
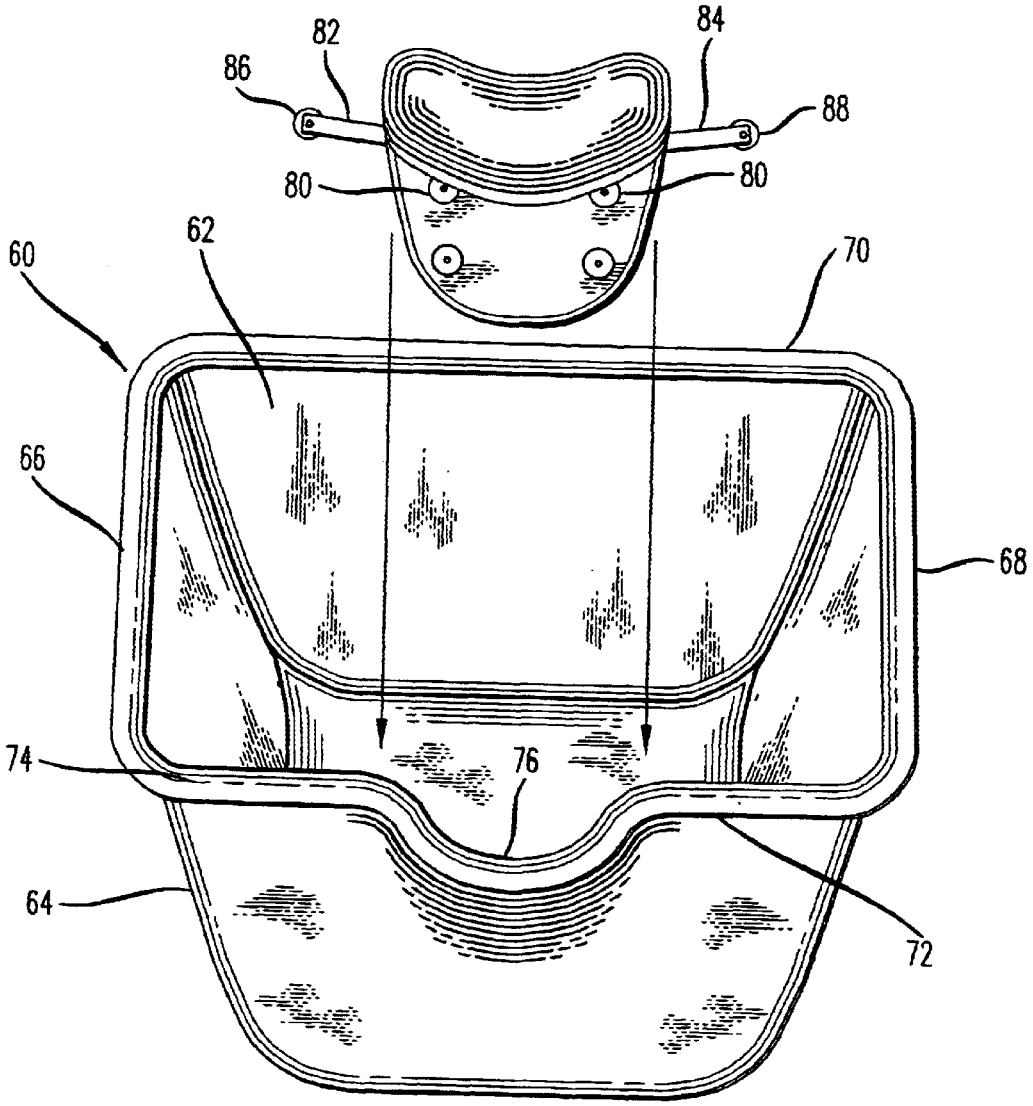
FIG. 4 is a perspective exploded view of an embodiment of the present invention incorporated with a barber's sink or beautician's sink.

FIG. 4 is an exploded prospective view of the preferred embodiment of the present invention incorporated with a standard salon or barber's sink. One will note that the salon or barber sink 60 comprises a basin 62 defined by a peripheral side wall 64 having generally parallel lateral side walls 66 and 68, a rear wall 70, and a front wall 72. The front wall 72 is defined by an upper edge 74 spanning the distance between the lateral side walls, the front wall having a centrally disposed arcuate depression 76 which is generally designed to conform to the circumference of the neck of an individual but which in practice is normally of greater circumference. Arcuate depression 76 in front wall 72, also protrudes outwardly from the front wall 72 in an arcuate manner. The design of the sink is thus such that when the individual in the salon chair or barber's chair is reclined, the head extends over the arcuate depression/arcuate protrusion portion of the front wall of the sink such that the individual's hair is positioned over the sink for shampooing, dying or the like. The fact that the individual's neck rests directly on the upper edge 74 of the front wall 72 of the sink 60 creates the problems addressed by the applicant.

FIG. 4 illustrates the neck support 10 in an exploded view with respect to sink 60 and the manner in which it overlays and engages the arcuate depression/arcuate protrusion portion of sink 60 such that the individual's upper spine and neck are supported by the resilient cushion and not the rigid surface of the sink edge. Neck support 10 would be slid vertically over arcuate depression 76, the operator would then apply moderate pressure to the outer surface of depending leg 42 so as to engage suction cups 80 with the inner surface of front wall 72 of sink 60 and then extend straps 82 and 84 and engage suction cups 86 and 88 with the outer surface of front wall 72.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. A neck support for individuals for use during hair treatment and shampooing when the individual is in a reclining position in a salon or barber's chair and the head of the individual is extended over a sink, the neck support comprising:

a resilient cushion adapted to be removably positioned over the upper edge of a standard configuration salon sink wherein said sink has a front wall having an inner surface, an exterior surface, an upper edge, and an arcuate depression in said front wall which also arcuately protrudes outwardly from said front wall, said arcuate depression for engagement with the neck of an individual when in a reclining position, said resilient cushion having opposing flared sidewalls, a front edge and a rear edge, an upper surface extending from said front edge to said rear edge, and said upper surface preformed to the cervical lordotic curve of said individual's upper spine and neck, said preformed upper surface being double curved having said first arcuate surface preformed to said cervical lordotic curve of said spine, said first arcuate surface extending from said front edge of said resilient cushion to said rear edge, and terminating in a planar dam surface partially transversing said preformed upper surface, said upper surface having a second arcuate surface extending transverse between said opposing flared side walls, said second arcuate surface being complimentary to the rear circumference of said individuals neck;

a base member formed on the underside of said resilient cushion and integral therewith, said base portion for removably securing said resilient cushion to said arcuate depression portion of said salon sink, said base member having a first depending leg and a second depending leg, said first depending leg having a curvature complimentary with said inner surface of said sink proximate with said arcuate depression and said arcuate protrusion, said second leg having a curvature complimentary with said curvature of said outer surface of said sink proximate said arcuate depression and said arcuate protrusion, said first leg and said second leg spaced apart and defining a surface complimentary with said upper edge of said sink at said arcuate depression and said arcuate protrusion, said spaced apart first leg and said second leg having formed therebetween flexible rib members deformable by said sink providing additional cushioning, said first leg member having a plurality of suction securing means for suction engagement with said inner surface of said sink, said second leg member having a plurality of suction securing means for suction engagement with said outer surface of said sink.

2. The neck support in accordance with claim 1 wherein said first depending leg engaging said inner surface of said sink depends downwardly further than said second depending leg.

3. The neck support in accordance with claim 2 wherein said first leg and said second leg being of a flexible resilient material.

4. The neck support in accordance with claim 1 wherein said suction means on said second leg are secured to said second leg by a strap means extending outwardly from said second leg means.

5. The neck support in accordance with claim 1 wherein said first depending leg and said second depending leg define a surface therebetween adapted to abut said arcuate depression in said upper edge of said front wall of said sink said distance between said depending first leg and said depending second leg being less than the distance between said inner surface and said exterior surface of said sink, said first depending leg being biased against said inner portion of said sink and said second depending leg being biased against said exterior surface of said sink to be attachably retaining said neck cushion in place on said sink edge.

* * * * *